US006948780B1

(12) United States Patent
Litman et al.

(10) Patent No.: US 6,948,780 B1
(45) Date of Patent: Sep. 27, 2005

(54) METHOD AND APPARATUS FOR THREADING A HELIX ONTO A COSMETIC BRUSH

(75) Inventors: Neal S. Litman, Pennington, NJ (US); Matthew Hong, Dix Hills, NY (US); Ron McCleary, Cheshire, CT (US)

(73) Assignee: E-L Management Corp., New York, NY (US)

( * ) Notice: Subject to any disclaimer, the term of this patent is extended or adjusted under 35 U.S.C. 154(b) by 0 days.

(21) Appl. No.: 10/876,169

(22) Filed: Jun. 24, 2004

(51) Int. Cl.[7] ..... A46D 3/00
(52) U.S. Cl. ..... 300/2
(58) Field of Search ..... 300/2, 10

(56) References Cited

U.S. PATENT DOCUMENTS 3,254,923 A * 6/1966 Theodore et al. ..... 300/21
6,295,994 B1 10/2001 Thayer et al.

* cited by examiner

*Primary Examiner*—Randall Chin

(57) ABSTRACT

An apparatus is provided for automatically mounting a helix on a radial bristle cosmetic brush, and in particular, a mascara brush. The brush has a twisted wire core and may be mounted to a plastic stem or rod that extends back to a cap/handle combination. The helix comprises a spiral series of adjacent coils. The helix is adapted to be mounted about the core of the brush such that the radially extending bristles of the brush project out between adjacent coils of the helix. The apparatus for mounting the helix on the brush comprises a base supporting a cradle. The cradle receives and aligns a helix and a brush. A pusher mounted next to the cradle slides the brush toward the helix such that the tip of the brush comes to rest against one end of the helix. A gripper holds the other end of the helix so that the helix is stationary relative to rotation of the brush. A rotator has a pair of jaws supporting wheels that grasp the stem of the brush. At least one of the wheels is driven to rotate the brush. As the brush is rotated, the helix is 'threaded' onto the brush in much the same way as a nut is threaded onto a screw. The gripper is mounted on a carriage that permits it to move freely toward the brush as the helix is drawn onto the brush. After the helix is drawn onto the brush, the rotator and gripper release the brush and helix assembly.

16 Claims, 5 Drawing Sheets

METHOD AND APPARATUS FOR THREADING A HELIX ONTO A COSMETIC BRUSH

BACKGROUND OF THE INVENTION

1. Field of the Invention

This invention relates to a method and apparatus for threading a helix onto a radial bristle cosmetic brush. More particularly, the invention relates to a method and machine for threading a helix on a twisted wire core cosmetic brush such as a mascara brush.

2. Description of the Prior Art

Brushes 27 having bristles extending radially from a central core are well known in the art (see, for example, FIG. 1). They may be made by fixing tufts of radially extending bristles in bores in a molded plastic central core. Alternatively, the core is commonly of the twisted wire type. A twisted wire core brush is typically comprised of a core 10 formed from a single metallic wire folded in a generally unshaped configuration to provide a pair of parallel wire segments. Bristles 18, usually comprised of strands or filaments of nylon or similar material, are disposed between a portion of a length of the wire segments. The wire segments are then twisted about each other, forming a twisted wire core 10 (also known as a helical core), with the bristles 18 secured in the twisted wire core substantially at their midpoints so as to clamp them. The bristle tip distribution generally approximates the helical or spiral path of the twisted wire core. In this way, a bristle portion or bristle head 28 is formed with regularly disposed radially extending bristles secured in the twisted wire core in a helical or spiral arrangement. The twisted wire core generally has a handle end 8 that extends beyond the bristle portion 28, thus providing a portion of the core for mounting the brush to a stem or rod 24, which in turn may be attached to a cap 26 that also serves as a handle. The cap forms the closure for a cosmetic container 30, such as, for example, a mascara tube. Reciprocal threads 16 and 29 may be provided on the cap and container, respectively, to secure the closure. The brush, rod and cap together form a brush assembly 22 (also known as an applicator). A longitudinal axis 23 is defined by the core 10. See, for example, U.S. Pat. No. 4,887,622 to Gueret, U.S. Pat. No. 4,733,425 to Hartel et al. and U.S. Pat. No. 5,370,141 to Gueret.

Also known is a radial bristle brush 27 as described above with a helix 9 (also referred to herein as a 'helical coil' or an 'added helix') mounted or threaded about the core and within the bristles 18 in the bristle head 28 (see FIG. 3). The helix 9 is made of metal, plastic or other suitable material, and is added to the brush to redistribute the bristles 18 of the underlying brush 27. A brush of this type is disclosed in U.S. Pat. No. 6,295,994 to Thayer et al., incorporated herein by reference in its entirety. The helix 9 (see FIGS. 2–3) has a generally cylindrical body comprised of a spiral series of successive loops or coils 7 winding about a longitudinal axis 17 defined approximately through the center of the longitudinal body. The cylindrically configured helix 9 is positioned coaxially about the core 10 of the brush 27 such that at least some bristles 18 extend radially between the successive loops or coils 7 of the helix. The characteristics of the helix, such as, for example, the internal dimension, the pitch, the thickness of the helix body, etc., are each selected to, for example, change the initial orientation of at least some of the bristles when the helix is in position about the core. Thus, the helix changes the physical arrangement of the brush by reorienting at least some bristles to yield a brush with selected characteristics. On a brush without a twisted wire core, the added helix can simulate the bristle pattern of a twisted wire core brush by providing a spiral arrangement of bristles. On a twisted wire core brush, bristles may be re-arranged to yield any one of a variety of bristle distributions.

However, the automated assembly of a helix onto a radial bristle cosmetic brush presents some challenges. For example, the assembly requires care to avoid undesired bristle re-distribution or damage. Forcing a helix onto the brush with too much pressure, or at a feed rate that is incompatible with the pitch of the helix or the bristle arrangement of the underlying brush may flatten or damage bristles, or undesirably bias bristles towards the brush tip or handle. Also, cosmetic brush assemblies such as mascara brushes come in a variety of shapes and sizes, with stems and/or caps of various dimensions. Because the helix may be mounted on the brush after the brush is secured to a stem and/or cap, the automated assembly apparatus must be readily adaptable to accommodate a variety of brush, stem and cap dimensions and arrangements. Accordingly, there is a need for an apparatus that can conduct the automated assembly of a helix onto a radial bristle brush in a manner that overcomes the foregoing challenges.

BRIEF SUMMARY OF THE INVENTION

An apparatus is shown and described for automatically mounting a helix on a cosmetic brush, and in particular, a mascara brush. The brush has a core defining a longitudinal brush axis. The core may be mounted at one end to a plastic stem or rod that extends back along the longitudinal brush axis to a cap/handle combination. Bristles extend radially from the core. The brush extends along the brush axis from a handle end to a free end. The helix comprises a spiral series of adjacent coils winding about a longitudinal helix axis from an inner end, for positioning closer to the brush handle end, to an outer end, distal to the brush handle end. The helix is adapted to be mounted about the core such that the brush axis and helix axis are substantially aligned and such that bristles of the brush are interspersed between adjacent coils of the helix. The apparatus for mounting the helix on the brush comprises a base supporting an assembly station that receives brushes and helixes from feed means. A cradle mounted on the base is adapted to receive and align the helix and the brush. A pusher mounted proximal to the cradle slides the helix and the brush such that the free end (or tip) of the brush comes to rest at a cradle stop. The pusher applies sufficient force so that the helix initially engages the brush. A rotator and a gripper are provided proximal to the cradle. The rotator captures the brush stem in jaws that are provided with rollers, and rotates it about its longitudinal axis. The gripper captures the helix and holds it from rotating but such that it is free to move axially relative to the rotating brush. As the brush is rotated it is 'threaded' into the helix (or, relatively speaking, the helix is 'threaded' onto the brush) in much the same way as a screw is threaded into a nut. One of the gripper or the rotator is adapted to slide freely relative to the other such that the brush is drawn freely into the helix. Thus, the threading of the brush into the helix proceeds without other external pressure or assistance from a pusher.

DETAILED DESCRIPTION OF THE INVENTION

Figure 1:
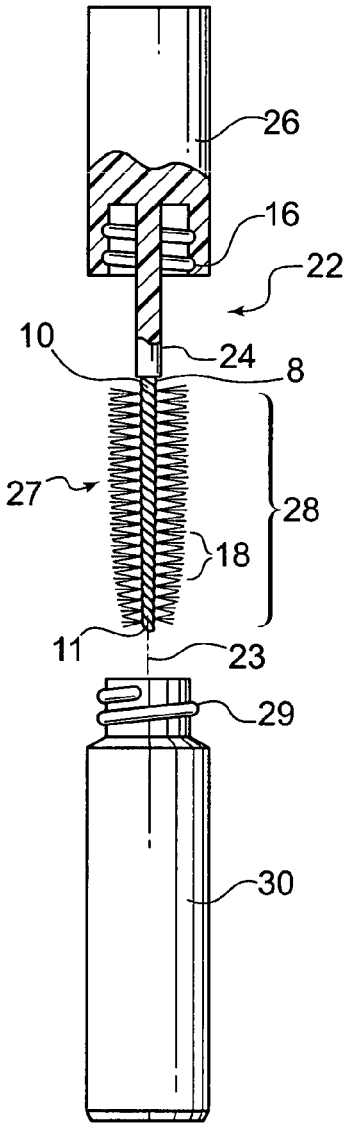
FIG. 1 is an elevation and partial sectional view of a prior art brush assembly and cosmetic container.
Figure 2:
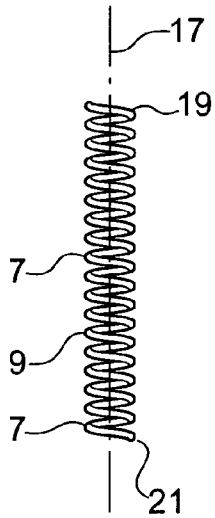
FIG. 2 is an elevation view of a helix.
Figure 3:
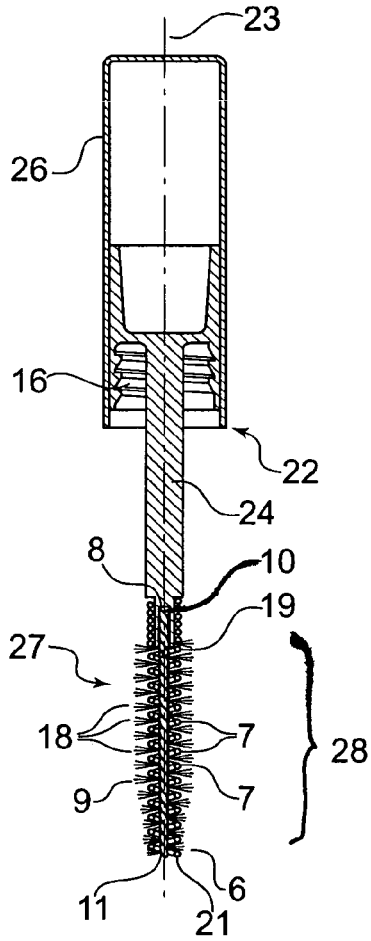
Fig. 3 (Prior Art)
FIG. 3 is a sectional elevation of a brush assembly with an added helix.
Figure 4:
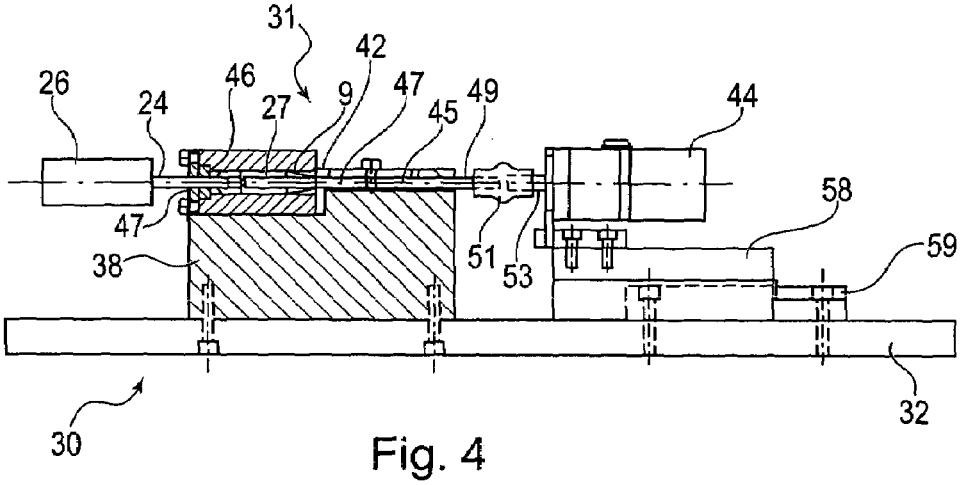
FIG. 4 is an elevation and partial sectional view of an apparatus according to the present invention.

An apparatus for automatically mounting a helix 9 on a radial bristle cosmetic brush 27 is shown generally at reference number 30 in FIG. 4. As shown in FIGS. 1 and 3, the brush 27 has a core 10 defining a longitudinal brush axis 23. The core 10 is mounted at one end (the handle end 8) to a plastic stem or rod 24 that extends back along the longitudinal brush axis 23 to a cap 26 (which also serves as a handle). Bristles 18 extend radially from the core 10. The brush extends along the brush axis 23 from the handle end 8 to a free end 11 (also referred to as the brush "tip"). The helix 9 comprises a spiral series of adjacent coils 7 winding about a longitudinal helix axis 17 from an inner end 19, adapted for mounting closer to the handle end 8 of the brush 27, to an outer end 21, adapted for mounting distal to the handle end 8 and proximal to the free end 11. The helix 9 is adapted to be mounted about the core 10 such that the brush axis 23 and helix axis 17 are substantially aligned and such that bristles 18 of the brush extend through and are interspersed between adjacent coils 7 of the helix.

Figure 6:
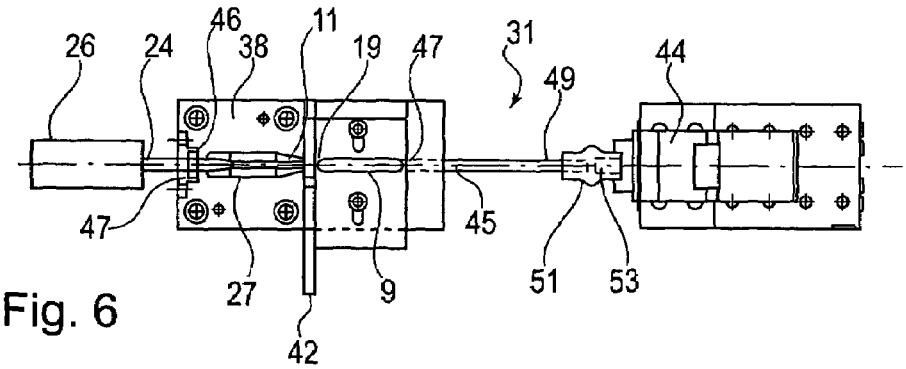
FIG. 6 is a partial plan view of the apparatus of FIG. 4 with the slide in the retracted position.
Figure 7:
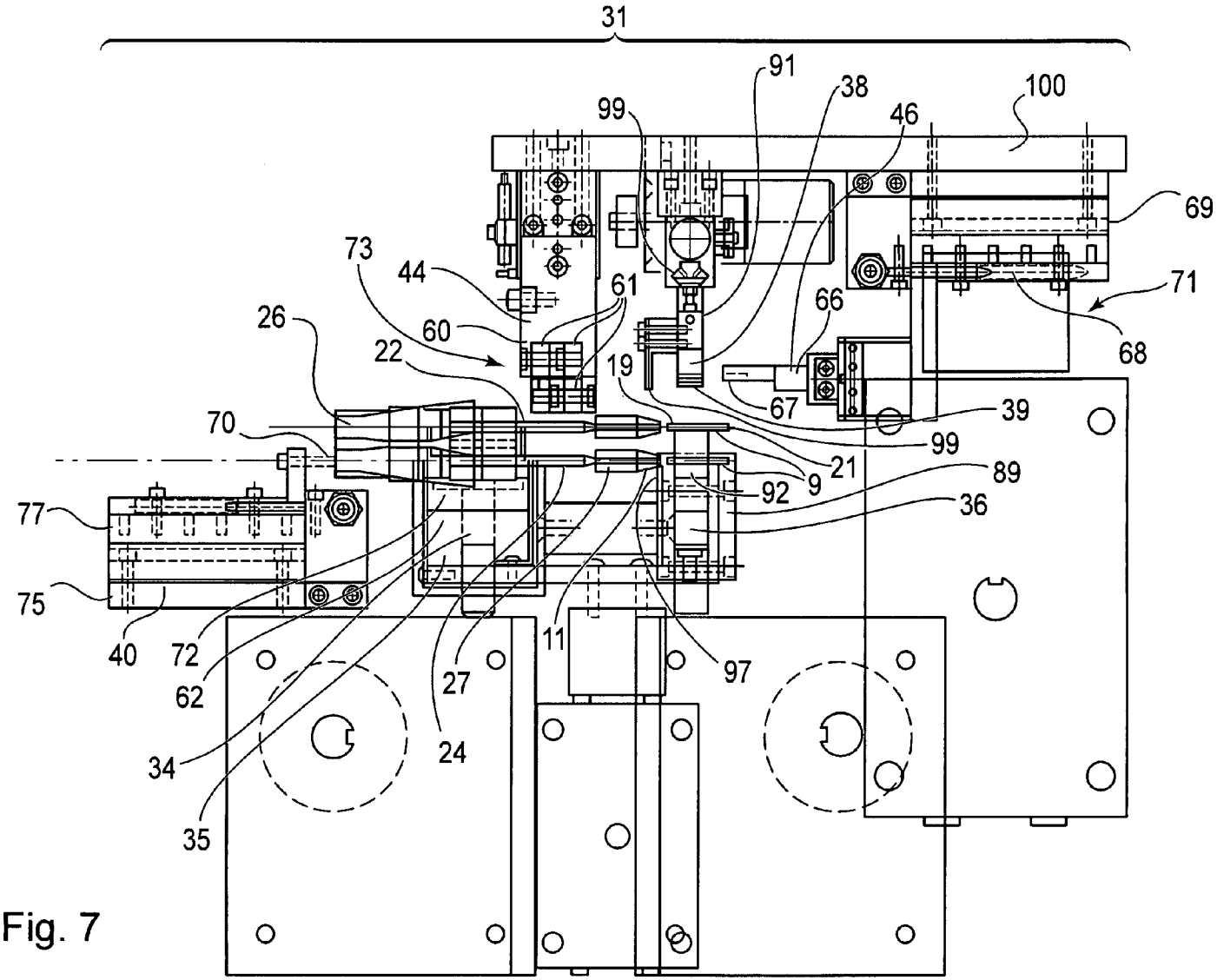
FIG. 7 is an end view of an alternative embodiment of the apparatus according to the invention.

The apparatus 30 for mounting the helix on the brush comprises a base 32 supporting an assembly station 31 that receives brushes 27 (or brush assemblies 22, each including a brush 27, stem 24 and cap 26) and helixes 9 from feed means (34, 36, respectively; see FIG. 7). A cradle 38 mounted on the base is adapted to receive at least one of the helix 9 and the brush 27 for axial alignment with the other. In the embodiment shown in FIGS. 4–6, the cradle 38 is adapted to receive both a brush and a helix such that they are in end-to-end alignment, with the free end 11 of the brush adjacent to the inner end 19 of the helix. Sufficient force and, if necessary, a slight rotation, is then applied to one of the brush or the helix such that the inner end 19 of the helix 9 initially contacts bristles of the free end 11 of the brush 27 in threaded engagement. A rotator 44 and a gripper 46 are provided proximal to the cradle to rotate one of the brush or the helix while holding the other stationary so that the helix is completely 'threaded' onto the brush.

Figure 5:
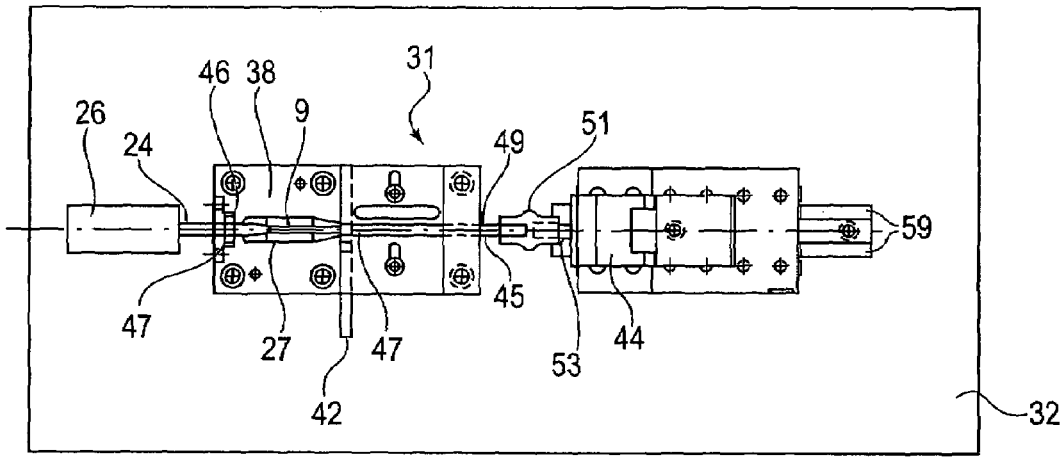
FIG. 5 is a plan view of the apparatus of FIG. 4 with a slide in an extended position.

In the first embodiment shown in FIGS. 4–6, the gripper 46 captures the brush assembly 22 in clamp 47, gripping the stem 24. However, it will be understood that the gripper may alternatively capture any suitable part of a brush 27 or brush assembly 22. For example, the gripper may capture the core 10 of a brush 27 that is not yet mounted on a stem in a brush assembly. Or, for example, where a brush 27 is already mounted on a brush assembly, the gripper may capture the cap 26. In any case, the gripper holds the brush 27 from rotating relative to the helix 9. In the embodiment shown in FIGS. 4–6, the rotator 44 is provided to engage the outer end 21 of the helix 9 on the distal end 37 of a mandrel 45 longitudinally aligned with the brush axis 23 and helix axis 17. The distal end 37 of the mandrel is adapted to provide sufficient engagement with the helix to thread it onto the brush as the mandrel is rotated. A proximal end 49 of the mandrel is connected to a shaft 53 of rotator 44 by a coupling 51. As the mandrel is rotated, the helix 9 is drawn onto the brush by the thread-like engagement of the helix with the bristles, much like a nut is drawn onto a screw. Thus, the helix is 'threaded' onto the brush. The rotator 44 is supported on a slide 58 that moves freely on a rail or rails 59 mounted on the base 32. As the rotator 44 turns and the helix 9 is threaded onto the brush 27, the slide 58 is drawn towards the gripper by the 'threaded engagement' of the brush and helix. In other words, no additional pressure or external force pushes the slide after the initial engagement of the brush and helix discussed above.

Figure 8:
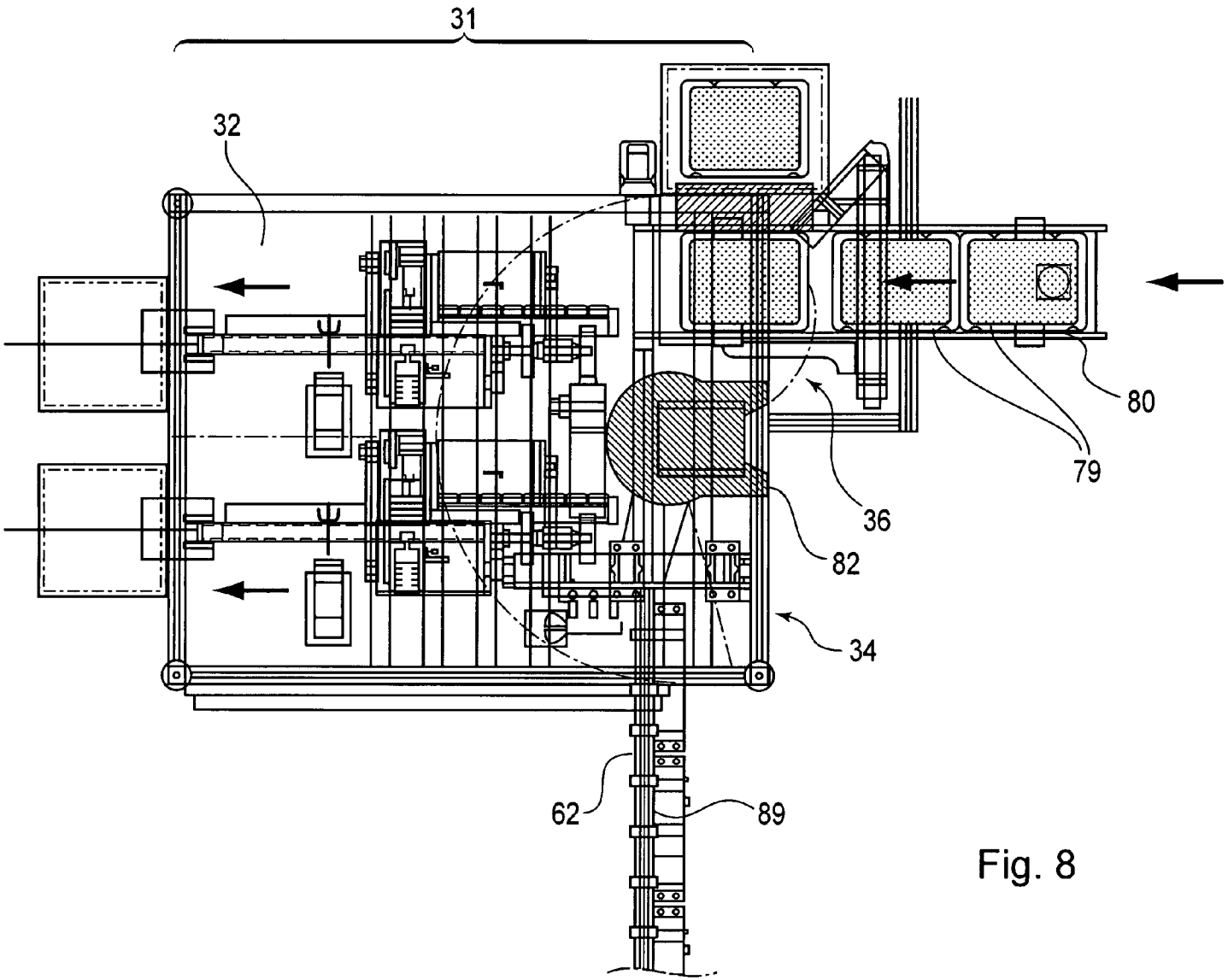
FIG. 8 is a plan view of the alternative embodiment of FIG. 7.

In the second embodiment shown in FIGS. 7 and 8, brush assemblies 22 are delivered to the assembly station 31 by feed means 34. The preferred feed means is a brush walking beam 62, which is mounted to the base 32. Each brush assembly 22 is carried in a recess or pocket 63 on the brush walking beam in an orientation transverse to the direction of transport (indicated by arrow 64) of the walking beam. The brush walking beam is driven to advance each brush assembly to an assembly area 73, and delivers each brush successively to a brush cradle 72 in the assembly area 73. At the assembly area (the point at which the helix will be threaded onto the brush), the brush walking beam is adapted to place the brush assembly into the brush cradle 72 and index down and out of the way temporarily so as not to interfere with the rotator and gripper. A brush pusher 70 is provided proximal to the brush cradle 72 and lateral to the brush walking beam such that it can be activated to contact and push against the cap 26 of the brush assembly. The pusher is mounted on a slide 77 which is in turn mounted on a rail or rails 75 secured to the base 32. The slide 77 is movable in a direction transverse to the brush walking beam, and is driven by means, such as, for example, hydraulics, compressed air, mechanical or electromechanical means. The slide is adapted to move such that the brush pusher 70 can successively contact and move each brush assembly 22 laterally relative to the brush walking beam (in the direction that the free end 11 of the brush 27 is directed). This movement of the brush assembly 22 by the pusher 70 places the brush assembly 22 in the proper position in the brush cradle 72 prior to being grasped by the rotator 44. The brush assembly is moved laterally until the tip comes to rest against a retractable stop 97. The retractable stop 97 is withdrawn when the brush is properly positioned, and the rotator 44 engages the brush to rotate it. Subsequent to withdrawal of the stop 97 and prior to engagement by the rotator 44, the pusher 70 may also provide an additional force and movement in the lateral direction to cause bristles of the free end 11 of the brush 27 to contact the inner end 19 of the helix 9 in preparation for threaded engagement.

Figure 9:
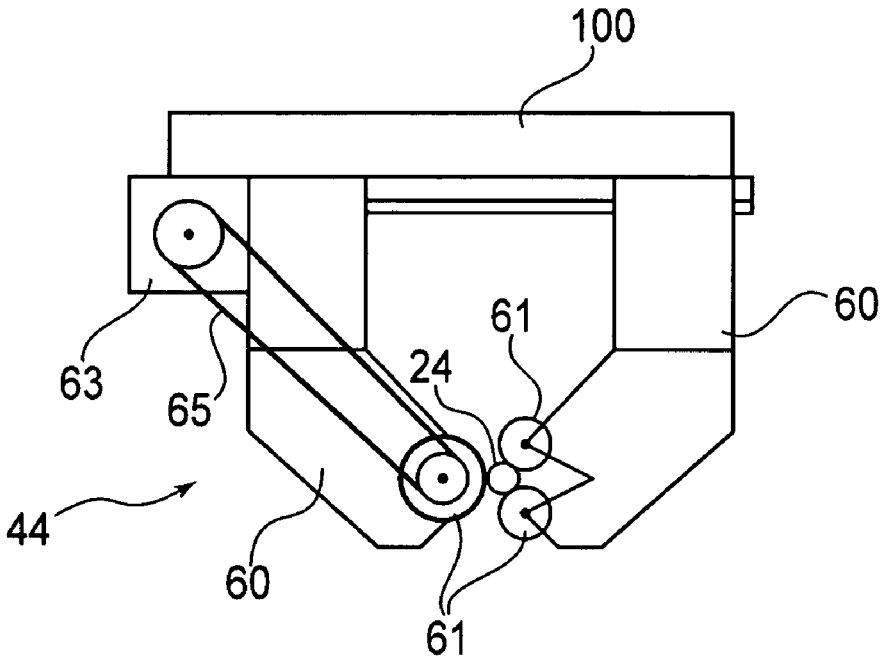
FIG. 9 is a detail elevation view of the rotator jaws.

Rotator 44 is located above the brush walking beam and includes a pair of rotator jaws 60 that are positioned to be lowered and grasp the stem of the brush assembly. In this embodiment, rotator 44 depends directly from beam 100 adjacent to grasping means 39. The rotator jaws 60 open to receive the brush assembly 22, descend and then close to capture the stem 24 of the brush assembly in a space defined between at least three wheels 61 mounted in the jaws 60. At least one of the wheels is driven by a motor 63 or other drive means. Preferrably the motor is a servo-motor that allows precise control and adjustment of rotational speed. It has been found that precise control of acceleration, speed and deceleration of rotation during the helix threading cycle is useful in achieving a quality brush and helix assembly. For example, a slower speed of rotation has been found to be advantageous when the threading cycle begins because relatively few brush bristles are engaged with the helix at the initiation of the threading. The bristles may be too few to support a higher rate of threading. As more bristles are engaged by the helix, the brush can be rotated more rapidly without negatively impacting the final product. The higher speed of rotation yields a higher rate of threading, and ultimately increases the output of finished brush and helix assemblies. In addition, the servo-motor can be slowed gradually toward the end of the threading cycle to avoid "slamming" of assembled components or machinery resulting from stopping rotation suddenly at the end of the threading cycle. As illustrated in FIG. 9, motor 63 is connected to one wheel 61 by way of a drive belt 65. The drive belt 65 is preferably a "timing" type belt with teeth that cooperatively engage teeth on the motor wheel and wheel 61 to avoid slippage. The brush assembly 22, including the brush 27, is rotated about the brush longitudinal axis by contacting the rotating driven wheel or wheels 61 to the stem 24. The wheels 61 not driven rotate freely so as not to interfere with rotation of the brush. Although the rotator could grasp any suitable part of the brush assembly to rotate it (e.g., the core, the stem or the cap), the stem is preferred for at least the following reasons. The stem is generally round in cross-section while the cap, for example, may be oval or square in cross-section, and the core, if made from twisted wire, may not be sufficiently round. Also, should the wheels scuff or otherwise damage the stem during the rotation of the brush assembly, the damage would be hidden inside the cosmetic container once the brush assembly is inserted in the container. Scuffing or damage to the external surface of the cap could diminish the aesthetic appeal of the finished brush assembly, necessitate remedial action or even result is discarding of otherwise sound assemblies.

Helixes 9 are delivered to the assembly station 31 by feed means 36. The helix feed means may include trays 79 that are delivered to the assembly station by a conveyor 80. The trays are delivered to a position on or proximal to the base 32. To prevent helixes from becoming entangled, each tray is provided with a plurality of compartments, with, for example, each compartment adapted to hold a single helix. A robotic arm 82 with a picker on a remote end is mounted on the base 32 such that the arm can swing to a first position over a tray on the conveyor. The remote end of the arm is provided with optical sensors so that it can locate a helix in a compartment on the tray for retrieval. The arm holding the helix swings from the first position over the tray to a second position over a helix walking beam 89 secured to the base 32. The robotic arm deposits the helix 9 in a recess or pocket on the helix walking beam 89. The helix walking beam 89 is driven to advance each helix toward the assembly area 73 in succession. The helix walking beam 89 also serves to index each helix opposite a brush assembly on the brush walking beam 62 wherein the longitudinal helix axis 17 is in alignment with the longitudinal brush axis 23 of each brush. Although referenced and described separately, it will be understood that the brush walking beam 62 and the helix walking beam 89 may be a single walking beam with a single drive means, or two separate but synchronized walking beams driven by one or more drive means. The means driving the walking beam or beams may be, for example, hydraulic, compressed air, mechanical or electromechanical means.

A component support beam 100 is mounted above the base 32 such that it is suspended above and transversely to the brush walking beam 62 and helix walking beam 89, and such that it is substantially parallel to the helix and brush axes in the respective walking beam. Means 39 for grasping, guiding or locating the helix relative to the brush and gripper prior to assembly is provided in the form of a "mid grip" 91 that depends from the beam 100 directly above the helix walking beam. The mid grip may include a pair of mid grip jaws dimensioned to receive and grasp, guide or locate a helix at a point between the inner and outer ends. The mid grip 91 receives a helix from the helix walking beam and grasps, guides or locates the helix temporarily as the helix walking beam drops clear of the assembly area. The mid grip serves to align the helix with a brush and with the gripper 46. The mid grip 91 is positioned directly above the helix walking beam and proximal to the gripper 46 to facilitate locating the helix such that the gripper can engage the helix. A mechanical or optical brush tip locator sensor 99 may also be provided proximal to the means 39 (the mid grip 91) to facilitate positioning the inner end 19 of the helix at the free end 11 of the brush.

The gripper 46 includes at least two gripper jaws 66 with free ends 67 adapted to close on and grasp the outer end 21 of a helix. Preferably, the gripper 46 including the jaws 66 is configured to remain stationary relative to the rotation of the brush, while, as explained in greater detail below, being freely movable axially. Also, the gripper and/or jaws are configured to avoid damaging the helix, and to avoid crushing or trapping bristles of the brush either between the gripper or mandrel and the helix, or under the helix. In particular, the free ends 67 of the jaws may be provided with clearances to avoid trapping brush bristles under the helix.

In the embodiment shown in FIGS. 7 and 8, the brush walking beam 62 and helix walking beam 89 are a single beam, and deliver a brush assembly 22 and a helix 9, respectively, to cradles 72, 92 in the assembly area. The walking beam delivers the brush assembly to the brush cradle 72 and the helix to the helix cradle 92. The brush cradle 72, helix cradle 92 and retractable stop 97 are preferably a single, integral component that supports and initially aligns the brush assembly and helix as the walking beam drops clear of the assembly area. The pusher 70 pushes the brush assembly in the cradle such that the free end 11 of the brush contacts one side of the retractable stop 97. The rotator 44 and mid grip 91 descend into the assembly area, and the gripper 46 moves laterally into the assembly area. The rotator 44 grasps the stem 24 of the brush assembly 22. As the helix 9 is being placed in the cradle by the walking beam, the helix 9 is directed by guides such that the inner end 19 is registered or justified against an opposite side of the stop 97 directly in line with the free end 11 of the brush. The mid grip 91 grasps the helix to align the inner end 19 of the helix with the free end 11 of the brush and to hold the helix such that the gripper 46 can engage the outer end 21. The free ends 67 of the jaws 66 of the gripper 46 engage the outer end 21 of the helix 9. As the rotator 44 and gripper 46 engage the brush assembly and helix, respectively, the cradles 72, 92 and stop 97 drop clear of the assembly area, and the rotator 44 begins to rotate the brush assembly 22 (including brush 27) to thread the helix onto the brush. As the helix begins to thread onto the brush, the mid grip 91 releases the helix.

The gripper 46 is mounted on a slide or carriage 68 which is in turn slidably mounted on a rail or rails 69 depending from beam 100. To allow the carriage to move as freely as possible, preferably, the friction between the carriage and the rail or rails is minimized as much as possible by the use of lubrication, ball bearings, roller bearings, low-friction materials (e.g., silicone, teflon or nylon based materials or lubricants), etc. Resistance to forward movement is further reduced by attaching "umbilical" connections to the side of the carriage rather than to the front or rear end. In addition, the carriage may be adapted to biased toward forward movement by pitching the rails slightly or by a spring or other mechanical means. The carriage bearing the gripper is initially in a "home" position, i.e., the position occupied by the gripper as it receives and engages the helix prior to the helix being mounted on the brush. As the rotator begins to rotate the brush in the direction of the spiral of the helix at a suitable speed, the carriage 68 is initially driven or biased from the home position on the rail or rails 69 towards the brush assembly by means, such as, for example, hydraulic, compressed air, mechanical or electromechanical means. The preferred drive means is a low pressure (less than 10 p.s.i.) "puff" of air delivered to the back of the carriage through a ⅛ inch diameter tube. Because friction between the carriage and the rails has been minimized, the force required to initially drive the carriage is minimal, e.g., a small, gentle puff of compressed air. This initial movement of the carriage advances the helix into contact with the rotating brush sufficient to initiate threaded engagement of the helix on the brush bristles. In the preferred embodiment, the driven carriage supporting the gripper acts as a helix pusher 71, moving the helix towards the brush to initiate threaded engagement between the brush and the helix when the brush is rotated. As noted previously, the brush pusher 70, which is principally for pushing the brush assembly into proper position in the assembly area 73, may additionally or optionally provide the movement of the brush towards the helix to facilitate initiation of threaded engagement of the brush and helix.

Shortly after threaded engagement of the helix and the brush has been initiated, the helix may be drawn onto the brush solely by the threaded engagement. This generally takes place after about 1 to 5 coils of the helix are engaged with the bristles. At this point, in response to the helix being drawn onto the brush by the threaded engagement, the carriage bearing the gripper 46 slides freely toward the brush to permit the helix to advance onto the brush. When the helix is completely threaded on the brush, i.e., when the outer end 21 of the helix is proximal to the free end 11 of the brush, the rotator jaws open to release the brush stem, the sliding of the gripper carriage stops and the gripper disengages from the helix. The carriage bearing the gripper is driven back to its home position by suitable means, e.g., hydraulic, compressed air, mechanical or electromechanical means. Similarly, the rotator withdraws to a position above the walking beam. The completed brush assembly with helix mounted is picked up by the brush and/or spring walking beam to be carried out of the assembly area to, for example, a collection bin.

The relative relationship of the gripper and rotater may be opposite that described above, i.e., the rotator may be mounted on a sliding carriage and the gripper may be fixed or stationary. However, it is preferred that the gripper be mounted on the sliding carriage because it has a significantly lower mass than the rotator (which includes a motor and wheels, belts and pulleys). When the rotator is mounted on the sliding carriage, the relatively higher mass of the rotator creates a greater inertial resistance to movement of the slide and thus greater force is required to overcome the inertial resistance to move the carriage. Conversely, the relatively lower mass of the gripper when mounted on the sliding carriage yields significantly lower inertial resistance to movement of the carriage, and hence, less force is required to move the carriage during the threading operation.

To illustrate the invention more particularly, the following example is given. A brush assembly is provided with a brush having a twisted wire core. The brush has a bristle head of nylon bristles with bristle envelope having a length of approximately 30 mm and a diameter of about 8 mm. The twisted wire core is about 40 mm long and has a diameter of about 1.43 mm. A helix is provided made from steel wire having a diameter of 0.51 mm. The body of the helix has an overall length just under 30 mm and is formed of loops having an inside diameter of about 2.16 mm. The loops of the helix spiral such that a line perpendicular to the wire forms an angle of about 8 degrees with the longitudinal axis of the helix. The helix spirals in a clockwise direction from the inner end to the outer end. The brush assembly is placed on the walking beam as described above, with the longitudinal axis of the brush assembly transverse to the direction of travel of the walking beam. The brush assembly is advanced on the walking beam to the assembly area beneath the rotator. The pusher moves the brush assembly laterally until the free end of the brush contacts the retractable stop. The retractable stop is withdrawn. Helixes are provided in a tray proximal to the walking beam. A robotic arm, such as, for example, a Robohand RPL 2, picks a helix from the tray and places it on the walking beam, such that the longitudinal axis of the helix is transverse to the walking beam, and such that the helix is opposite and indexed to a brush assembly. In the assembly area, the rotator jaws close on and grasp the stem of the brush assembly, the mid grip closes on and holds or guides the helix, and the gripper jaws close on and grasp the outer end of the helix. Then the walking beam indexes down and out of the way of the assembly process. The rotator begins to rotate the brush, for example, in the direction of the spiral of the helix. The gripper is initially driven to advance on its slide such that the helix initially engages the free end of the brush in threaded engagement. The rotator continues to rotate the brush assembly, relatively slowly at first, until sufficient bristles have engaged the helix to permit increasing the rate of rotation. As the brush assembly, including the brush, rotates, the helix is threaded or drawn onto the brush. The gripper, holding the helix stationary relative to the rotation of the brush, moves freely towards the brush assembly as the sliding carriage supporting the gripper follows the helix onto the brush. The mid grip opens to release the helix. When the full length of the helix is nearly mounted on the brush, the motor gradually slows to avoid "slamming" of the components or machinery. When the full length of the helix is fully mounted on the brush, the motor stops and the rotator jaws open to release the brush assembly and the gipper jaws disengage from the helix. The rotator, mid grip and the gripper carriage withdraw from the assembly area and return to their respective starting positions. The completed brush assembly with helix mounted is picked up by the walking beam to be carried out of the assembly area to be deposited in a collection bin.

Assembly of helixes on radial bristle brushes according to the invention allows the helix to 'self-thread' at a substantially uniform rate that is determined by the interaction of the pitch of the helix spiral with the bristles of the brush. This is a significant improvement over forced-feed or fixed-feed-rate systems that are known to adversely affect bristles by bending or flattening bristles in undesirable ways, rendering the resulting bristle patterns less-effective from practical and aesthetic standpoints.

The gripper, mid grip and rotator are preferably adjustable to accommodate brushes, brush assemblies and helixes of various dimensions. Thus, the apparatus of the invention allows the assembly of helixes on a simple brush (i.e., a core with a bristle head), as well as on more complex brush assemblies (e.g., a brush attached to a stem and cap). The flexibility of the apparatus and the variety of brush/helix assemblies that this flexibility produces facilitates short or promotional run production, production run changes and just-in-time production. The apparatus facilitates the use of less expensive generic brushes or brush assemblies, yet yeilds a variety of bristle patterns normally associated with higher cost applicators. The apparatus can be co-located with, for example, the cosmetic container filling and capping operations.

In the preferred embodiment, frictional contact rotating the brush assembly is substantially limited to the stem, thus avoiding scuffing or other undesirable damage to external surfaces of the cap, or damage to the brush head.

The invention is well suited to produce consistent, high quality brush and helix assemblies. Brushes produced by the invention have more desirable bristle patterns, perform better and have more desirable aesthetic attributes. The invention is particularly useful for large volume mass production, and minimizes manual labor and associated costs.

While the invention has been described and illustrated as embodied in preferred forms of construction, it will be understood that various modifications may be made in the structure and arrangement of the parts without departing from the spirit and the scope of the invention recited in the following claims.

What is claimed is:

1. An apparatus for mounting a helix on a brush, the brush having a core defining a longitudinal brush axis and bristles extending radially from the core, the brush extending along the brush axis from a handle end to a free end, the helix comprising a spiral series of adjacent coils winding about a longitudinal helix axis from an inner end to an outer end, the helix mountable about the core such that the brush axis and helix axis are substantially aligned and such that bristles are interspersed between adjacent ones of the coils, the apparatus comprising:

a base;

alignment means mounted on the base, the alignment means adapted to receive and position the helix and the brush in axial and longitudinal alignment with the free end of the brush adjacent the inner end of the helix;

a rotator mounted above the base and adapted to rotate one of the brush about the brush axis and the helix about the helix axis;

a gripper mounted above the base and opposite the rotator, the gripper adapted to grasp the other of the brush and the helix; and means for moving at least one of the brush and the helix toward the other to cause the free end of the brush to contact the inner end of the helix;

wherein the rotator rotates one of the brush and the helix relative to the other causing the helix to be threaded onto the brush, and wherein at least one of the rotator and the gripper is adapted to move freely toward the other in response to the helix being threaded onto the brush.

2. The apparatus of claim 1 wherein the means for moving is selected from one of a mechanical pusher and an air jet mounted above the base and adjacent the alignment means.

3. The apparatus of claim 1 wherein the alignment means further comprises a mid grip with a pair of mid grip jaws adapted to grasp, guide or locate the helix at a point between the inner end and the outer end.

4. The apparatus of claim 1 wherein the alignment means further comprises a cradle adapted to receive at least one of the helix and the brush.

5. The apparatus of claim 1 wherein the alignment means further comprises a brush cradle adapted to receive the brush, and a helix cradle adjacent to and axially aligned with the brush cradle, the helix cradle adapted to receive the helix.

6. The apparatus of claim 1 wherein the rotator further comprises a pair of rotator jaws and at least three wheels rotatably mounted within the rotator jaws, the at least three wheels defining a space to receive the at least one of the brush and the helix, and at least one of the wheels is driven to cause the rotation of the at least one of the brush and the helix.

7. The apparatus of claim 6 wherein the space is adapted to receive at least one of a handle, a core or a stem of the brush.

8. The apparatus of claim 1 further comprising a brush walking beam mounted to the base, the brush walking beam adapted to transport successive ones of the brush to the alignment means.

9. The apparatus of claim 1 further comprising a helix walking beam mounted to the base, the helix walking beam adapted to transport successive ones of the helix to the alignment means.

10. The apparatus of claim 1 further comprising a tray for storing a plurality of helixes and a robotic arm adapted to successively pick at least one helix from the plurality of helixes, and deliver said one helix to the helix walking beam.

11. The apparatus of claim 1 wherein the gripper further comprises a pair of gripper jaws adapted to grasp one of the brush and the helix.

12. The apparatus of claim 11 wherein the gripper jaws are adapted to grasp the brush and hold it substantially stationary relative to rotation of the helix.

13. The apparatus of claim 11 wherein the gripper jaws are adapted to grasp the outer end of the helix and hold the helix substantially stationary relative to rotation of the brush.

14. The apparatus of claim 1 further comprising a rail mounted on the base and a slide movably mounted on the rail, the slide supporting the rotator such that the rotator moves freely toward the gripper in response to the helix being threaded onto the brush.

15. The apparatus of claim 1 further comprising a rail mounted over the base and a carriage movably mounted on the rail, the carriage supporting the gripper such that the gripper moves freely toward the rotator in response to the helix being threaded onto the brush.

16. An apparatus for mounting a helix on a brush, the brush having a core defining a longitudinal brush axis and bristles extending radially from the core, the brush extending along the brush axis from a handle end to a free end, the helix comprising a spiral series of adjacent coils winding about a longitudinal helix axis from an inner end to an outer end, the helix mountable about the core such that the brush axis and helix axis are substantially aligned and such that bristles are interspersed between adjacent ones of the coils, the apparatus comprising:

a base;

a cradle mounted on the base, the cradle adapted to receive at least one of the helix and the brush, the cradle adapted to position the at least one of the helix and the brush in axial alignment with the other, wherein the free end of the brush is adjacent the inner end of the helix;

a rotator mounted proximal to the cradle, the rotator adapted to rotate one of the helix and the brush;

a gripper mounted opposite the rotator, the gripper adapted to grasp the other of the helix and the brush; and a pusher mounted proximal to the cradle, the pusher adapted to slide one of the brush and the helix such that the free end of the brush contacts the inner end of the helix;

wherein the rotator rotates one of the brush and the helix relative to the other causing the helix to be threaded onto the brush, and wherein at least one of the rotator and the gripper is adapted to move freely toward the other in response to the helix being threaded onto the brush.

* * * * *